US012390079B2

(12) United States Patent
Gambrel

(10) Patent No.: US 12,390,079 B2
(45) Date of Patent: Aug. 19, 2025

(54) STANDPIPE FOR A WAREWASHING MACHINE

(71) Applicant: Brian Gambrel, Corbin, KY (US)

(72) Inventor: Brian Gambrel, Corbin, KY (US)

( * ) Notice: Subject to any disclaimer, the term of this patent is extended or adjusted under 35 U.S.C. 154(b) by 252 days.

(21) Appl. No.: 18/119,777

(22) Filed: Mar. 9, 2023

(65) Prior Publication Data

US 2023/0284860 A1 Sep. 14, 2023

Related U.S. Application Data

(60) Provisional application No. 63/318,271, filed on Mar. 9, 2022.

(51) Int. Cl.
*A47L 15/42* (2006.01)

(52) U.S. Cl.
CPC ..... *A47L 15/42* (2013.01); *A47L 15/4223* (2013.01)

(58) Field of Classification Search
USPC ..... 134/56 D, 57 D, 58 D, 109
See application file for complete search history.

(56) References Cited

U.S. PATENT DOCUMENTS

2009/0100880 A1* 4/2009 Hill ..... D06F 39/02 222/416
2013/0025637 A1* 1/2013 Francisco ..... A47L 15/4223 210/136
2013/0291896 A1* 11/2013 Durham ..... A47L 15/0049 134/113
2019/0150699 A1* 5/2019 McCrate ..... A47L 15/4202

* cited by examiner

*Primary Examiner* — Levon J Shahinian
(74) *Attorney, Agent, or Firm* — Nelson Mullins Riley & Scarborough LLP

(57) ABSTRACT

A standpipe for a warewashing machine defining a drain aperture, the standpipe having an elongated tubular body having an open top end defined by a top edge and an open bottom end, and a cover portion including a base wall and a continuous sidewall extending downwardly from an outer perimeter of the base wall, wherein a bottom edge of the sidewall of the cover portion extends downwardly beyond the top edge of the elongated body.

15 Claims, 7 Drawing Sheets

STANDPIPE FOR A WAREWASHING MACHINE

CLAIM OF PRIORITY

This application claims priority to U.S. provisional application No. 63/318,271 filed on Mar. 9, 2022, the disclosure of which is incorporated by reference herein.

FIELD OF INVENTION

The present invention relates generally to warewashing machines. More particularly, the present invention relates to warewashing machines including standpipe assemblies to prevent the unintentional loss of water during dishware cleaning operations.

BACKGROUND

Warewashing machines perform cleaning and sanitizing cycles on dishware that may utilize water at high temperatures, e.g., up to 180° F. Regulations exist that put an upper limit of 140° F./60° C. on the temperature of wastewater that may be discharged into a building's drainage system. For example, Chapter 7, Section 701.7 of the 2018 International Plumbing Code provides that "wastewater when discharged into the building drainage system shall be at a temperature not higher than 140° F. (60° C.). When higher temperatures exist, approved cooling methods shall be provided." Regulations dictate this upper limit on wastewater drainage because, when drained, wastewater initially flows down into traps provided in the building's drainage piping that are intended, among other things, to trap grease and prevent the grease from flowing down further into the drainage system, where it may solidify and cause blockages. If wastewater exceeding the defined limit is allowed to drain, and thus enter the traps, the wastewater can melt or dislodge the previously solidified grease from the traps, allowing the grease to flow downstream within the drainage system where it can re-solidify, possibly causing a blockage at a point that is not readily accessible. As well, various components, such as, but not limited to, piping, fittings, gaskets, etc., may be formed of materials, such as, but not limited to, polyvinylchloride (PVC), nylon, etc., that may be damaged by excessive heat. One of the approved cooling methods is the use of a drain water tempering system, as shown in FIG. 1, to mix cold water with the hot wastewater as it drains from the warewashing machine.

FIG. 1 provides a partial view of a warewashing machine 10 including an interior volume 12 in which dishwares 69 (FIG. 6) to be cleaned are disposed, a hot water tank 16 that stores a volume of water 19 that is recirculated within the interior volume 12 by a recirculation pump 18 during cleaning and sterilization operations, and a drain water tempering system 20 that connects the hot water tank 16 to the drainage system (not shown) of a building. Referring additionally to FIGS. 2A and 2B, a known drain water tempering system 20 includes a drain water fitting 22 and a drain tempering valve 24. Drain water fitting 22 includes a substantially cylindrical body 21 defining an interior chamber 23, a drain water inlet port 25 in fluid communication with a drain 17 on the bottom wall of hot water tank 16, a cold water inlet port 27 that is in fluid communication with a cold water source (not shown) of the building as well as interior chamber 23 of drain water fitting 22, and a drain water outlet port 29 that is in fluid communication with the drain system of the building.

Referring specifically to FIG. 1, in operation, a standpipe 30 has an open bottom end 32 that is seated within drain 17 of hot water tank 16 so that hot water accumulates within the hot water tank 16 until the level of hot water 19 reaches an open top end 34 of the standpipe 30. Preferably, the volume of hot water 19 within hot water tank 16 is utilized for multiple cleaning cycles of multiple sets of dishware, for example, up to six to eight cleaning cycles, before the hot water is drained. As shown in FIG. 2B, the used wastewater is drained from hot water tank 16 by moving standpipe 30 in an upward direction, such as by a lever or handle (not shown), thereby unseating open bottom end 32 of standpipe 30 from drain 17 of hot water tank 16. As such, the wastewater disposed within hot water tank 16 is now free to drain into interior chamber 23 of drain water fitting 22.

Drain tempering valve 24 includes a temperature sensor 26 that extends inwardly into interior chamber 23 of the drain water fitting. Drain tempering valve 24 may be a mechanical valve including a bimetallic switch (not shown). The set point of the drain tempering valve's bimetallic switch is adjusted to desired threshold temperature, such as 160° F., so that when temperature sensor 26 is immersed in large amounts of draining wastewater (indicated by arrow 13) that exceeds the set point, such as when a bottom end 32 of standpipe 30 is withdrawn from drain 17 of hot water tank 16, as shown in FIG. 2B, the bimetallic switch changes state, thereby causing drain tempering valve 24 to open so that cold water from the cold water source flows into interior chamber 23 of drain water fitting 22. This mixes the cold water with the draining wastewater prior to the wastewater exiting drain water outlet port 29, thereby lowering the temperature of the water exiting outlet port 29. As long as the temperature of the wastewater within interior chamber 23 of drain water fitting 22 exceeds the valve's set point, the bimetallic switch will maintain drain tempering valve 24 in its open position. Once the temperature of the wastewater with interior chamber 23 no longer exceeds the set point, the bimetallic switch changes state, thereby closing the drain tempering valve 24 and securing the flow of cold water into the drain water fitting 22.

Often, commercial warewashing machines are designed such that their hot water tanks 16 are only required to be drained after multiple dishware cleaning cycles, for example six to eight cycles, which facilitates water conservation. Although known drain water tempering systems may function properly when the hot water tank is purposefully being drained, problems are known to exist during repeated cleaning cycles in which standpipe 30 remains in the seated position within drain 17, as shown in FIG. 1. Specifically, referring additionally to FIG. 2A, during the repeated cleaning cycles of the dishware, small amounts of hot water (indicated by arrows 11) can enter the open top end 34 of standpipe 30 and flow down the standpipe's inner surface into interior chamber 23 of drain water fitting 22. The amount of hot water that passes through standpipe 30, and the rate at which the hot water passes, is typically not great enough to cause the water to accumulate within drain water fitting 22. Rather, the small amounts of hot wastewater drain continuously from drain water fitting 22 into the drainage system. Such hot water accumulation within interior chamber 23 is not great enough to submerge, or even make contact with, temperature sensor 26 of drain tempering valve 24. As a result, drain tempering valve 24 remains in the closed position, and cold water is not mixed with the hot wastewater. The draining wastewater exits drain water fitting 22 at substantially the same temperature as that of the volume of hot water 19 that is stored within hot water tank 16. As noted above, temperatures of up to 180° F. are often utilized during typical cleaning and sanitizing operations, meaning known drain water tempering systems may allow wastewater drainage exceeding the threshold temperature set by regulations to enter the drainage system of the corresponding building.

The present invention recognizes and addresses considerations of prior art constructions and methods.

SUMMARY

An embodiment of the present disclosure provides a standpipe for a warewashing machine defining a drain aperture, the standpipe including an elongated tubular body having an open top end defined by a top edge and an open bottom end, and a cover portion including a base wall and a continuous sidewall extending downwardly from an outer perimeter of the base wall, wherein a bottom edge of the sidewall of the cover portion extends downwardly beyond the top edge of the elongated body.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1:
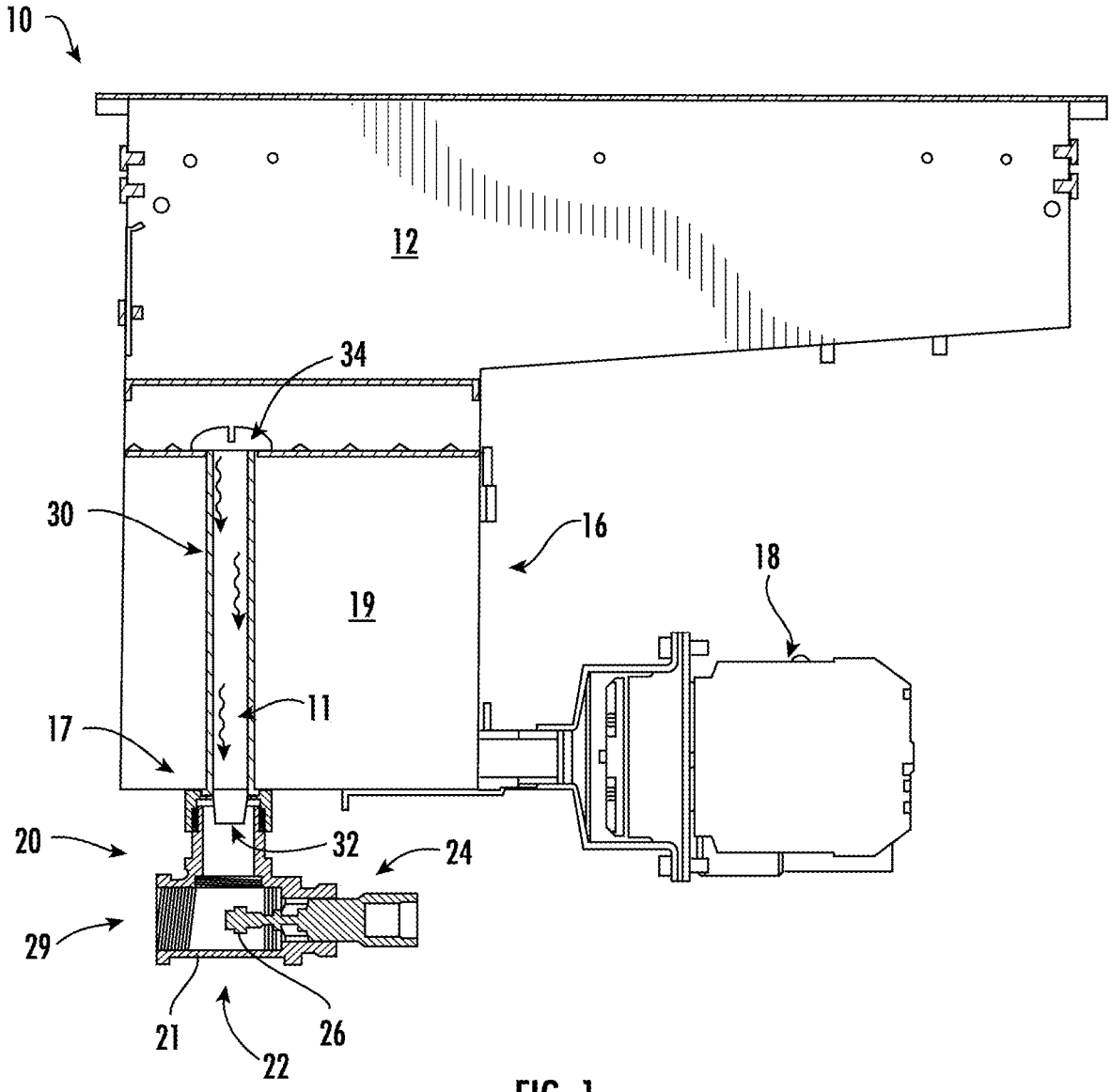
FIG. 1 PRIOR ART
FIG. 1 is a partial cross-sectional view of a warewashing machine including a prior art standpipe.

Repeat use of reference characters in the present specification and drawings is intended to represent same or analogous features or elements of the invention according to the disclosure.

DETAILED DESCRIPTION OF THE PREFERRED EMBODIMENTS

Reference will now be made in detail to presently preferred embodiments of the invention, one or more examples of which are illustrated in the accompanying drawings. Each example is provided by way of explanation, not limitation, of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 3:
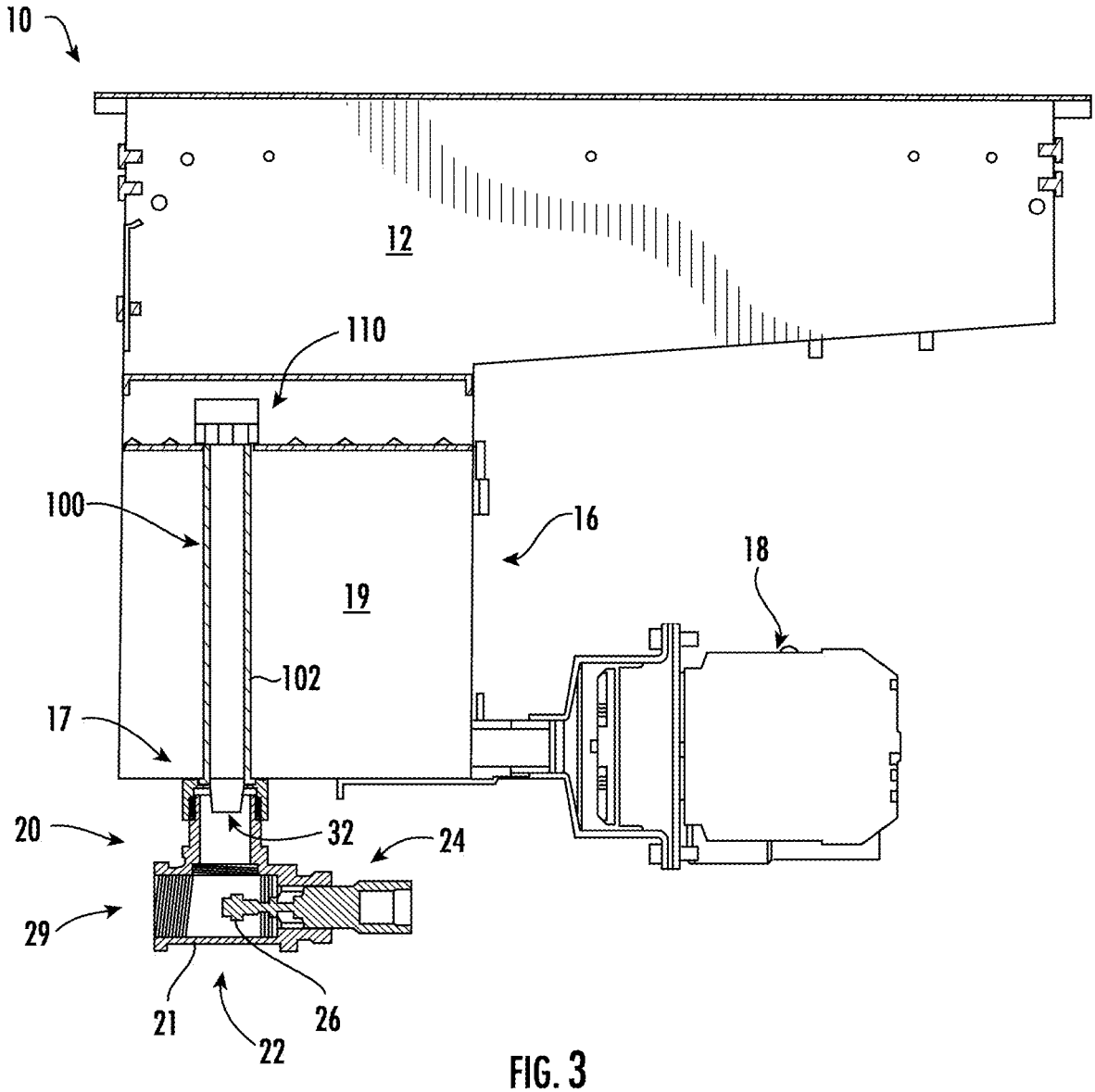
FIG. 3 is a partial cross-sectional view of a warewashing machine including a standpipe in accordance with an embodiment of the present invention.
Figure 6:
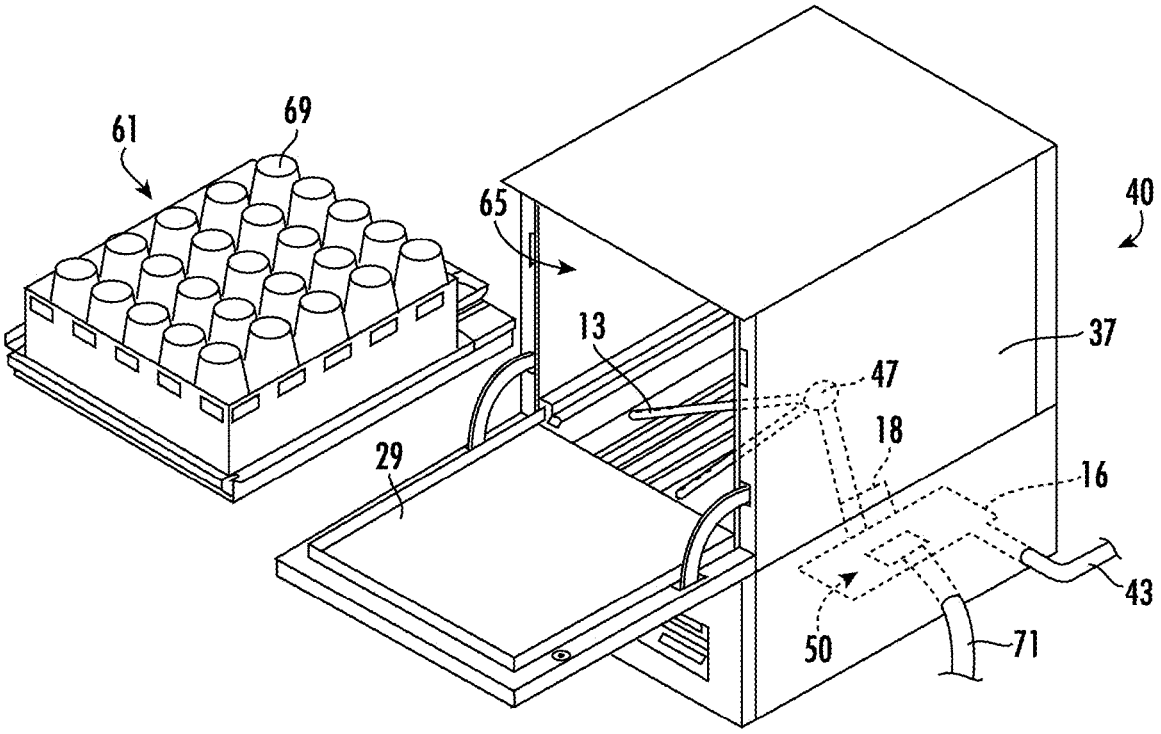
FIG. 6 is a perspective view of a warewashing machine including the standpipe shown in FIGS. 5A, 5B, and 5C.

As used herein, terms referring to a direction or a position relative to the orientation of the warewashing machine, such as but not limited to "vertical," "horizontal," "top," "bottom," "above," or "below," refer to directions and relative positions with respect to the warewashing machine's orientation in its normal intended operation, as indicated in FIGS. 3 and 6. Thus, for instance, the terms "vertical" and "top" refer to the vertical orientation and relative upper position in the perspective of FIGS. 3 and 6 and should be understood in that context, even with respect to a warewashing machine that may be disposed in a different orientation.

Further, the term "or" as used in this application and the appended claims is intended to mean an inclusive "or" rather than an exclusive "or." That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an" as used in this application and the appended claims should generally be construed to mean "one or more" unless specified otherwise or clear from the context to be directed to a singular form. Throughout the specification and claims, the following terms take at least the meanings explicitly associated herein, unless the context dictates otherwise. The meanings identified below do not necessarily limit the terms, but merely provide illustrative examples for the terms. The meaning of "a," "and," and "the" may include plural references, and the meaning of "in" may include "in" and "on." The phrase "in one embodiment," as used herein, does not necessarily refer to the same embodiment, although it may.

Referring now to the figures, specifically FIGS. 3 and 5A through 5C, a warewashing machine 10 including a standpipe 100 in accordance with an embodiment of the present disclosure is shown. Preferably, the standpipe 100 includes an elongated body 102 formed by a cylindrical tube having an open bottom end 104 that is defined by a frustoconical end wall 106. The outer surface of the frustoconical end wall 106 forms a water-tight seal with the drain 17 when the bottom end 104 of the standpipe 100 is received therein, as shown in FIG. 3. Note, in alternate embodiments, the elongated body 102 of the standpipe 100 may be formed by a tubular body of a cross-section other than circular.

Figure 4A:
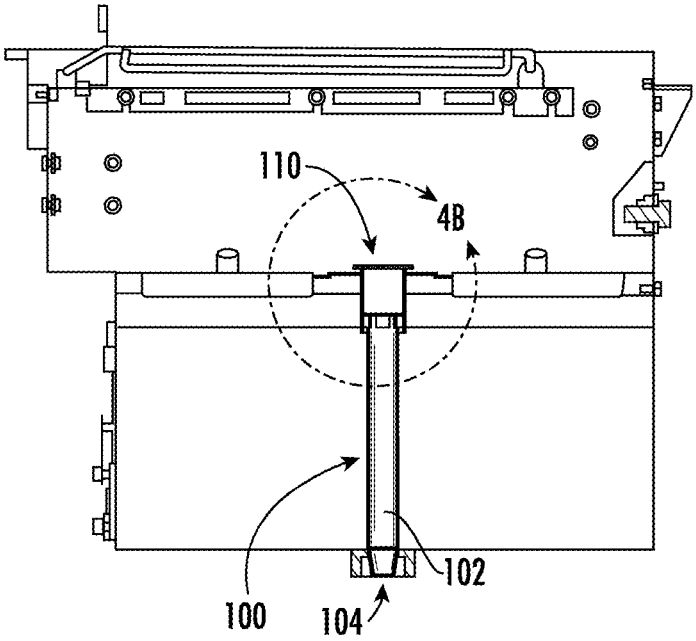
FIGS. 4A and 4B are partial cross-sectional views of the warewashing machine shown in FIG. 3.
Figure 4B:
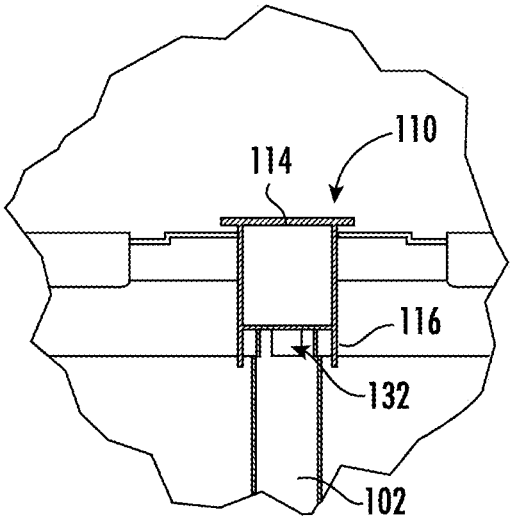
Figure 5A:
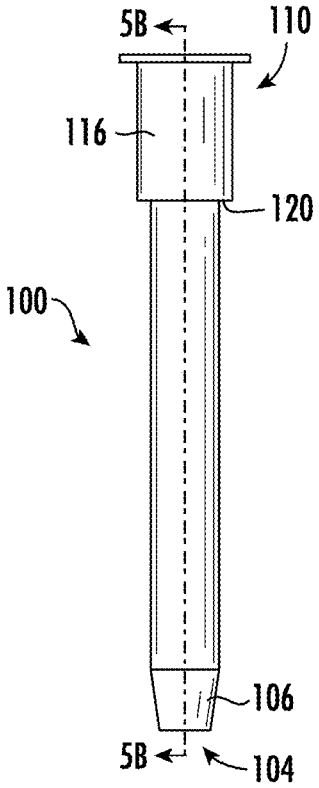
FIGS. 5A, 5B, and 5C are side, cross-sectional, and partial cross-sectional views of the standpipe shown in FIGS. 4A and 4B.
Figure 5B:
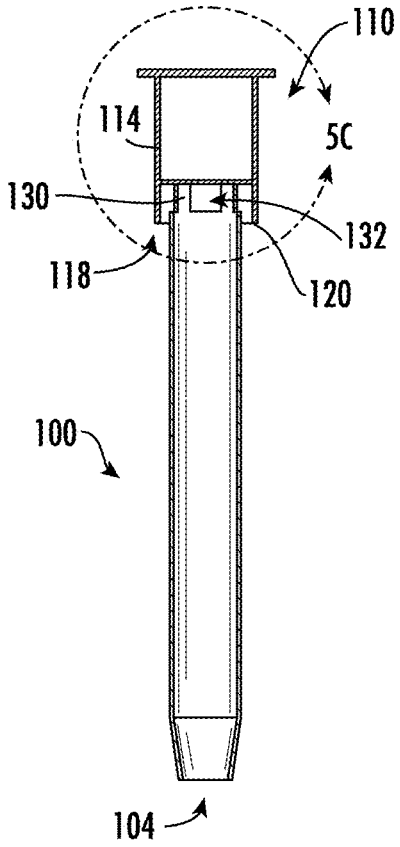
Figure 5C:
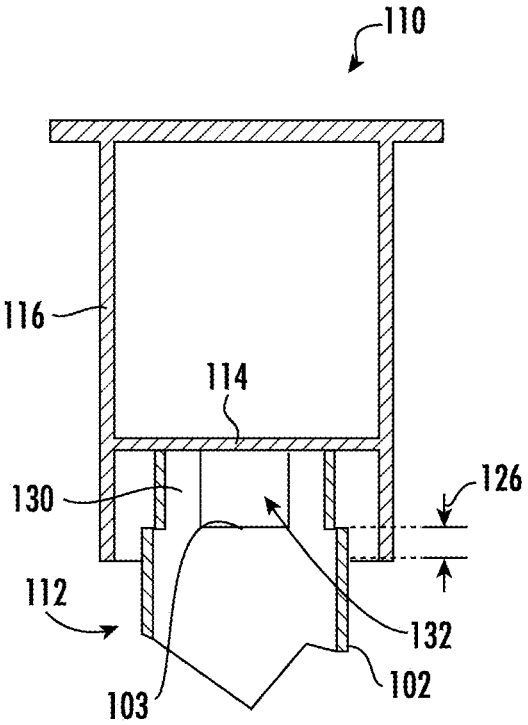

As best seen in FIGS. 4B and 5C, rather than an open top end 34 (FIG. 1) as in existing standpipes 30, the disclosed standpipe 100 includes a cover portion 110 affixed to the top end 112 of the elongated body 102. Preferably, the cover portion 110 includes a circular base wall 114 that is fixed to the top end 112 of the elongated body 102, and a cylindrical sidewall 116 that extends downwardly from the circular outer perimeter of the base wall 114, thereby forming an annular gap 118 between the sidewall of the elongated body 102 and the bottom edge 120 of the sidewall 116 of the cover portion 110. As shown, the bottom edge 121 of the cover's sidewall 120 extends downwardly beyond the top edge 103 of the elongated body 102. This axial overlap 126 of the cover portion 110 with regard to the top end 12 of the elongated body 102 allows the cover portion 110 to prevent hot water being used to clean dishwares from entering the elongated body 102 of the drain due to turbulent flow within the warewashing machine 10. Note, however, the cover portion 110 is fixed to the elongated body 102 of the standpipe 100 by a plurality of posts 130 defining drain apertures 132 therebetween. As such, should the volume of hot water in the warewashing machine exceed the height of the top edge 103 of the elongated body 102, the cover portion 110 allows hot water to enter the standpipe 100, thereby passing through the drain 117 and preventing an overflow condition.

Referring additionally to FIG. 6, the operation of a warewashing machine 40 including the standpipe 100 shown in FIGS. 5A through 5C is discussed. With regard to the illustrated example, an operator initially places a rack 61 with dishware 69 into the interior volume 65 of warewashing machine 40. Warewashing machine 40 has a housing 37 that defines interior volume 27 a front opening thereof, and that includes a door 29. A water source, e.g., a municipal water supply, is indicated by an input water line at 43. A pump (not shown) draws water from water source 43 and drives the water into a hot water tank 16 that includes a heating unit, the hot water tank being disposed in the lower part of housing 37. A recirculation pump 18 forces the heated water up to an agitation unit 47 having a plurality of arms 13 (only two of which are indicated in FIG. 6) that rotate about a vertical axis while spraying pressurized water upward therefrom. Upon the return of door 29 to its upright position and the user's actuation of warewashing machine 40, the machine's control circuitry applies electrical power to the heating unit to heat the incoming water from source 43 at up to approximately 180° F. or another predetermined temperature level, e.g. approximately 160° F. or 165° F., and recirculation pump 18 pumps the heated water to agitation unit 47/13, which sprays the heated water upward through apertures in rotating spray arms 13, thereby cleaning and sanitizing the dishware, as should be understood. Upon completion of the sanitization and cleaning operations on dishware 69, the operator removes rack 61 from the warewashing machine 40 such that another cleaning operation of dishware disposed in another rack may be performed. As previously noted, multiple cleaning operations are preferably performed utilizing substantially the same water that is initially received within hot water tank 16.

Referring additionally to FIGS. 3 and 5C, in operation, the open bottom end 102 of the standpipe 100 is seated within drain 17 of hot water tank 16 so that hot water accumulates within the hot water tank 16 until the level of hot water 19 reaches the top edge 103 of the elongated body 102 of the standpipe 100. Preferably, the volume of hot water 19 within hot water tank 16 is utilized for multiple cleaning cycles of multiple sets of dishware, for example, up to six to eight cleaning cycles, before the hot water is drained. Similarly to FIG. 2B, the used wastewater is drained from hot water tank 16 by moving standpipe 100 in an upward direction, such as by a lever or handle (not shown), thereby unseating open bottom end 102 of standpipe 100 from drain 17 of hot water tank 16. As such, the wastewater disposed within hot water tank 16 is now free to flow into the drain system. As previously noted, existing drain tempering systems 50 are known to function properly when adequate amounts of hot wastewater are purposefully drained from warewashing machines.

Figure 2A:
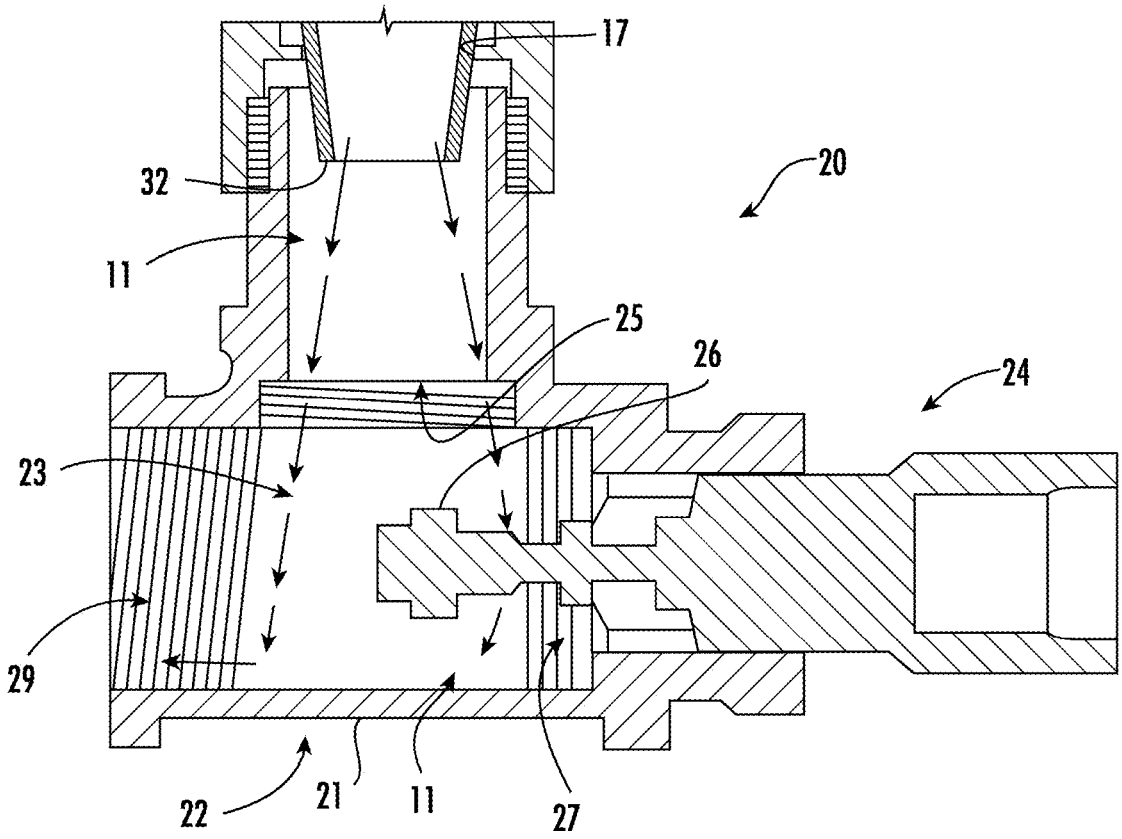
FIG. 2A PRIOR ART
FIGS. 2A and 2B are partial cross-sectional views of the warewashing machine and standpipe shown in FIG. 1.
Figure 2B:
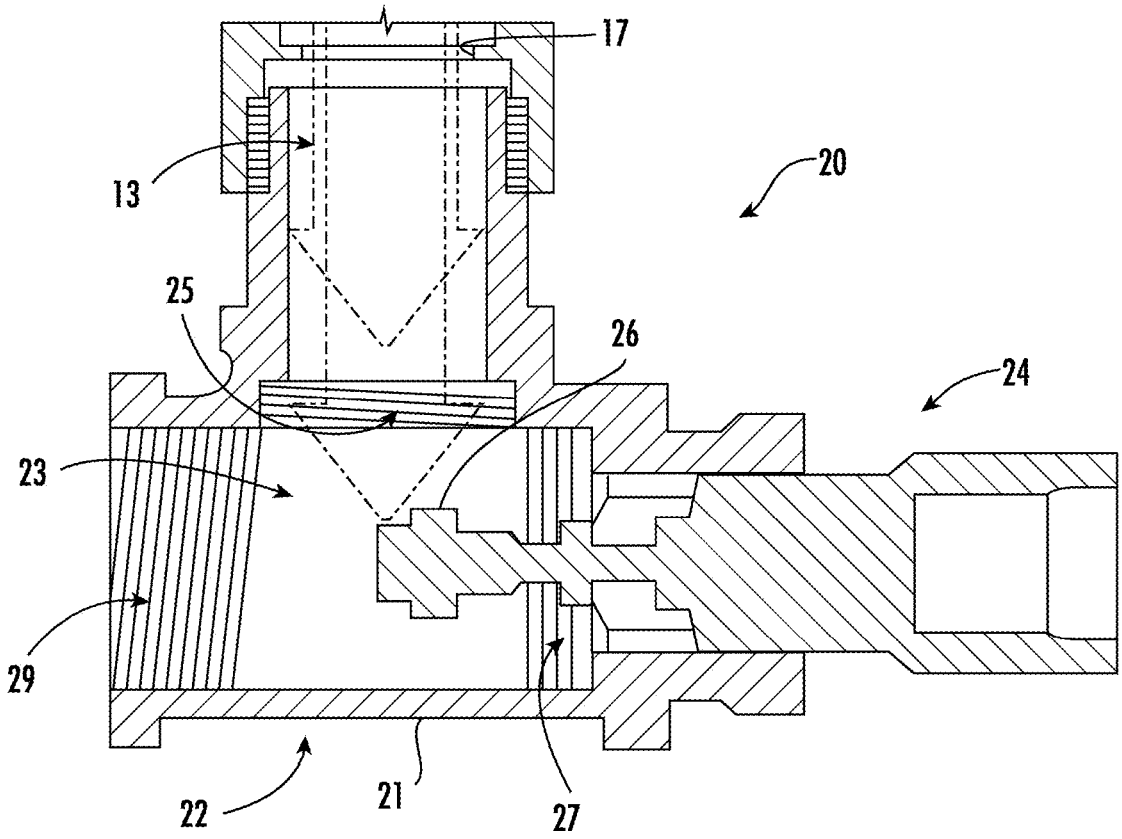
FIG. 2B PRIOR ART

As previously discussed, commercial warewashing machines are often designed so that their hot water tanks 16 are only drained after multiple dishware cleaning cycles, for example six to eight cycles. Referring specifically to FIGS. 1 and 2A, during the repeated cleaning cycles of warewashing machines 10 having prior art standpipe 30, hot water (indicated by arrows 11) may enter the open top end 34 of standpipe 30 and flow down the inner surface of standpipe 30 into interior chamber 53 of drain water fitting 52. Unlike the previously discussed prior art standpipes 30, such as that shown in FIG. 1, in which turbulent flow within a warewashing machine allows hot water (indicated by arrows 11) to drain continuously from the machine. The cover portion 110 of the disclosed standpipe 100 only allows hot water to drain when the level of the water exceeds the height of the top edge 103, or when the user withdraws the standpipe 100 from the drain. Specifically, the sidewall 120 of the cover portion 110 extends downwardly beyond the top edge 103, thereby preventing any hot water due to turbulent flow from entering. Rather, the height of the hot water must rise above both the bottom edge 121 of the cover portion's sidewall 120 and the top edge 103 of the standpipe's elongated body 102 so that the hot water may pass through the annular gap 118 defined therebetween and enter the standpipe 100 through the drain apertures 132. In short, the axial overlap 126 between the concentric sidewalls of the top end 112 of the elongated body 102 and the bottom end of the cover portion 110 prevent the turbulent flow of water from splashing into the open top end 112 of the standpipe 100.

While one or more preferred embodiments of the invention are described above, it should be appreciated by those skilled in the art that various modifications and variations can be made in the present invention without departing from the scope and spirit thereof. It is intended that the present invention cover such modifications and variations as come within the scope and spirit of the appended claims and their equivalents.

The invention claimed is:

1. A standpipe for a warewashing machine defining a drain aperture, the standpipe comprising:

an elongated tubular body having an open top end defined by a top edge and an open bottom end; and a cover portion including a base wall and a continuous sidewall extending downwardly from an outer perimeter of the base wall, wherein the cover portion axially overlaps the top end of the elongated tubular body such that a bottom edge of the sidewall of the cover portion extends downwardly beyond the top edge of the elongated body and defines a gap between the sidewall of the cover portion and the elongated tubular body through which fluid can flow from an exterior of the cover portion into the top end of the elongated tubular body.

2. The standpipe of claim 1, wherein the sidewall of the cover portion and the tubular body are both cylindrical and the sidewall of the cover portion is concentric to the tubular body.

3. The standpipe of claim 2, wherein the gap is an annular recess defined between the bottom edge of the sidewall of the cover portion and the open top end of the tubular body.

4. The standpipe of claim 1, wherein the open bottom end of the tubular body is defined by a frustoconical sidewall.

5. A standpipe for a warewashing machine, the warewashing machine including a hot water tank defining a drain aperture, the standpipe comprising:

an elongated body having a first open end defining a first edge and a second open end opposite the first open end, wherein the second open end is configured to be removably seated in the drain aperture of the hot water tank of the warewashing machine;

a cover portion coupled with the elongated body and disposed over the first open end, the cover portion defining a base wall and a sidewall extending about the base wall, the sidewall defining a cover portion open end opposite the base wall;

wherein the first edge of the first open end of the elongated body is located interior of the sidewall of the cover portion and a gap is defined between the first open end and the sidewall;

wherein the gap is in fluid communication with the cover portion open end such that fluid exterior of the cover portion can flow through the cover portion open end, through the gap, and into the first open end of the elongated body.

6. The standpipe of claim 5, wherein the base wall of the cover portion is fixed to the first edge of the of the elongated body by a plurality of posts, the plurality of posts defining a plurality of drain openings therebetween.

7. The standpipe of claim 5, wherein the first open end of the elongated body is concentric with the sidewall of the cover portion.

8. The standpipe of claim 5, wherein the gap is annular in shape.

9. The standpipe of claim 5, wherein, when the second open end is removably seated in the drain aperture of the hot water tank of the warewashing machine and the hot water tank is filled with water, a surface level of the water is above the sidewall open end and below the first open end of the elongated body.

10. A standpipe for a warewashing machine, the warewashing machine including a hot water tank defining a drain aperture, the standpipe comprising:

a tubular elongated body having a proximal end configured for engagement with the drain aperture of the water tank of the warewashing machine and a distal end opposite the proximal end, wherein the proximal end defines a proximal end opening that is in fluid communication with a distal end opening located at the distal end;

a cover located at the distal end of the elongated body, the cover comprising a first wall and a sidewall depending from a periphery of the first wall, wherein the first wall is coupled with the distal end of the elongated body and wherein the sidewall defines cover opening opposite the first wall;

wherein the cover opening is located proximal of the distal end opening and wherein the sidewall is spaced apart from the distal end of the elongated body to define a fluid path extending from an exterior of the cover, between the distal end of the elongated body and the sidewall, through the distal end opening, and to the proximal end opening.

11. The standpipe of claim 10, wherein the first wall is circular in shape.

12. The standpipe of claim 10, wherein when the proximal end is engaged with the drain aperture of the hot water tank of the warewashing machine and the hot water tank is filled with water, the distal end opening is above a surface level of the water and the cover opening is below a surface level of the water.

13. The standpipe of claim 10, further comprising a plurality of drain openings disposed between the first wall and the distal end of the elongated body.

14. The standpipe of claim 10, wherein the cover further comprises a second wall opposite the first wall and distal thereof, and wherein the sidewall extends between the first wall and the second wall.

15. The standpipe of claim 10, wherein the cover is configured to engage a lever or handle operable to raise the elongated body relative to the drain aperture of the hot water tank.

* * * * *